United States Patent [19]

Abrahams

[11] 4,106,293

[45] Aug. 15, 1978

[54] STIRLING CYCLE MACHINE WITH A CONTROL DEVICE FOR SUPPLYING WORKING MEDIUM

[75] Inventor: Jacobus Hubertus Abrahams, Eindhoven, Netherlands

[73] Assignee: U.S. Philips Corporation, New York, N.Y.

[21] Appl. No.: 778,686

[22] Filed: Mar. 17, 1977

[30] Foreign Application Priority Data

Apr. 2, 1976 [NL] Netherlands ..... 7603430

[51] Int. Cl.[2] ..... F02G 1/06

[52] U.S. Cl. ..... 60/521

[58] Field of Search ..... 60/521, 522, 525

[56] References Cited

U.S. PATENT DOCUMENTS

| | | | |
|---|---|---|---|
| 3,914,940 | 10/1975 | Bergman | 60/521 |
| 4,052,853 | 10/1977 | Abrahams | 60/521 |

*Primary Examiner*—Allen M. Ostrager

*Attorney, Agent, or Firm*—Frank R. Trifari; David R. Treacy

[57] ABSTRACT

A multi-space Stirling cycle reciprocating machine having a control device for supplying working medium to the working spaces. A pressure-controlled annular body in the device allows passage of working medium to the working spaces, exclusively by shape changes, each time at the relevant maximum cycle pressure.

3 Claims, 12 Drawing Figures

STIRLING CYCLE MACHINE WITH A CONTROL DEVICE FOR SUPPLYING WORKING MEDIUM

BACKGROUND OF THE INVENTION

1. Field of the Invention

The invention relates to a hot-gas reciprocating machine having two or more working spaces, whose volumes can be varied at a mutual phase difference by piston-like bodies coupled to a crank shaft, a working medium which performs a thermodynamic cycle in each of the working spaces during operation, and a control device for supplying working medium; and more particularly to such a machine whose control device has a housing having an inlet which is connected to a source of pressurized working medium and a plurality of outlets, each of which outlets is separately connected to an associated working space. The housing accommodates a control member which, during each revolution of the crank shaft, successively brings each of the outlets separately into open communication with the inlet, each time for a period during which the maximum cycle pressure occurs in the interconnected working space.

Such a hot-gas reciprocating machine operating according to the Stirling cycle is known from the Netherlands patent application No. 7,407,951 laid open to public inspection, to which U.S. Pat. No. 4,045,978 corresponds.

In the context of the present invention, hot-gas reciprocating machines are to be understood to mean hot-gas reciprocating engines, cold-gas refrigerating machines and heat pumps. In each of the working spaces of these machines, the working medium is alternately compressed, when it is present mainly in a sub-space (the compression space) after which it is transported, through a regenerator, to another sub-space (the expansion space) subsequently, when the greater part of the working medium is present in the expansion space, it expands and is finally returned, through the regenerator, to the compression space, the cycle thus having been completed. The compression and the expansion space have mutually different mean temperatures during operation.

The piston-like bodies which vary the volumes of the various working spaces are coupled to the crank shaft at a different crank angle relative to each other.

As a result, a mutual phase difference exists between the working spaces as regards the volume or pressure variation occurring in each working space.

The power of the machine can be increased by increasing the quantity of working medium present in the various working spaces of the machine.

2. Description of the Prior Art

In the hot-gas reciprocating machine which is known from U.S. Pat. No. 4,045,978, the control device consists of a rotor which is rotatable relative to the enveloping housing and which is coupled to a shaft of the machine, the rotor also being reciprocable in the axial direction under the influence of a pressure on one side corresponding to an instantaneous cycle pressure (for example, the minimum, the mean or the maximum cycle pressure) which periodically occurs in a working space, and the source pressure on the other side.

When the power of this hot-gas reciprocating machine is to be increased, working medium is initially fed, exclusively by rotation of the rotor, to each working space during each revolution of the crankshaft for the period in which the maximum cycle pressure occurs in the relevant working space. Thus, the highest pressure of the working medium increases, so that the supplied working medium participates directly in the expansion, without the machine first having to perform compression work on the supplied medium, which would cause an initial decrease of the torque. Subsequently, a gradual change-over takes place from supplying working medium at maximum cycle pressure to that at minimum cycle pressure because, due to on the one hand the increasing continuous pressure acting on the rotor, representing the instantaneous cycle pressure and due to the decreasing source pressure acting on the rotor on the other hand, the rotor gradually assumes an axial position so that all outlet ports of the housing come into open communication with the inlet port.

The known hot-gas reciprocating machine has some drawbacks. The high working medium pressures necessitate proper sealing of the rotor shaft relative to the housing in order to prevent leakage of working medium to the surroundings. The service life of a high-pressure seal between mutually rotating parts, however, is short.

The control mechanism must satisfy very severe requirements as regards dimensional accuray (for example, narrow ducts in the rotor in the correct position in view of the instant of feeding of working medium).

Because a slip-free coupling between the rotor and a shaft of the machine is required, there is little freedom of choice of the position in which the control device is arranged.

SUMMARY OF THE INVENTION

The invention has for its object to eliminate the described drawbacks by providing a hot-gas reciprocating machine comprising a control device of a very simple construction.

In a hot-gas reciprocating machine in accordance with the invention the control member is formed by an annular body which has a plurality of wall elements which are distributed over its circumference and which are subject on one side, viewed in radial directions, to the source pressure, while the other side of each wall element cooperates in a sealing manner with an associated outlet where they are subject to the variable cycle pressure occurring in the connected working space. The body is constructed so that the wall elements close or release the outlets by changes of the shape of the body due to the variable forces acting on it as a result of the variable differential pressures prevailing across the wall elements.

In a preferred embodiment in accordance with the invention, the annular body consists of a piece of flexible tubing of a synthetic material. This construction is very simple and cheap.

In a further preferred embodiment of the hot-gas reciprocating machine in accordance with the invention a pressure-controlled switch is included in a main communication duct, one end of which is connected to the source of pressurized working medium, while the other duct end is connected to the working spaces through communication ducts which are separately connected to the working spaces and each of which includes a non-return valve which opens in the direction of the associated working space. The switch switches off the control device and releases the main communication duct when a given pressure level in the working spaces is exceeded, and closes the main communication duct and switches on the control device when the pressure becomes lower than the given pressure level.

When working medium is fed to the working spaces, the pressure level in the working spaces increases and the pressure of the working medium in the source decreases, so that it becomes increasingly difficult to feed working medium to a cycle at maximum cycle pressure. The switch ensures that at a given instant working medium is fed, through the central communication duct, to the working spaces each time when the minimum cycle pressure occurs in a working space.

The invention will be described in detail hereinafter with reference to the drawing.

DESCRIPTION OF THE PREFERRED EMBODIMENTS

Figure 1:
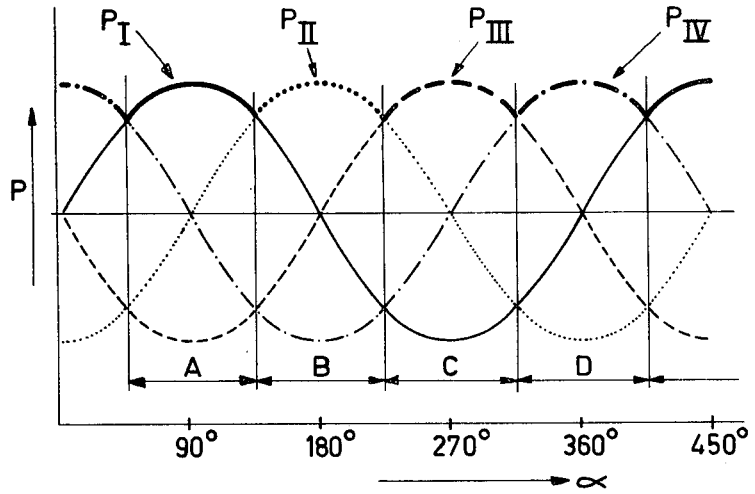
FIG. 1 graphically illustrates the pressure variation for the four thermodynamic cycles, phase-shifted 90° relative to each other, of a four-spaced Stirling cycle hot-gas reciprocating machine.
Figure 3A:
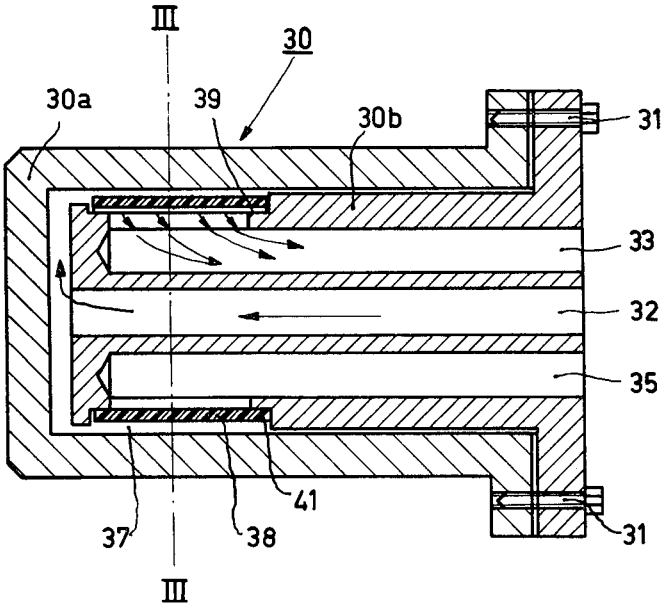
FIG. 3*a* is a longitudinal sectional view of an embodiment of the control device.

FIG. 1 shows the pressure P as a function of the time-dependent crank shaft angle $\alpha$ for the four cycles I, II, III and IV (denoted by an uninterrupted line, a dotted line, a dashed line and a dash/dot line, respectively) of a four-space hot-gas reciprocating machine, the cycles having a mutual phase difference of the cycle pressure of 90°.

Figure 2:
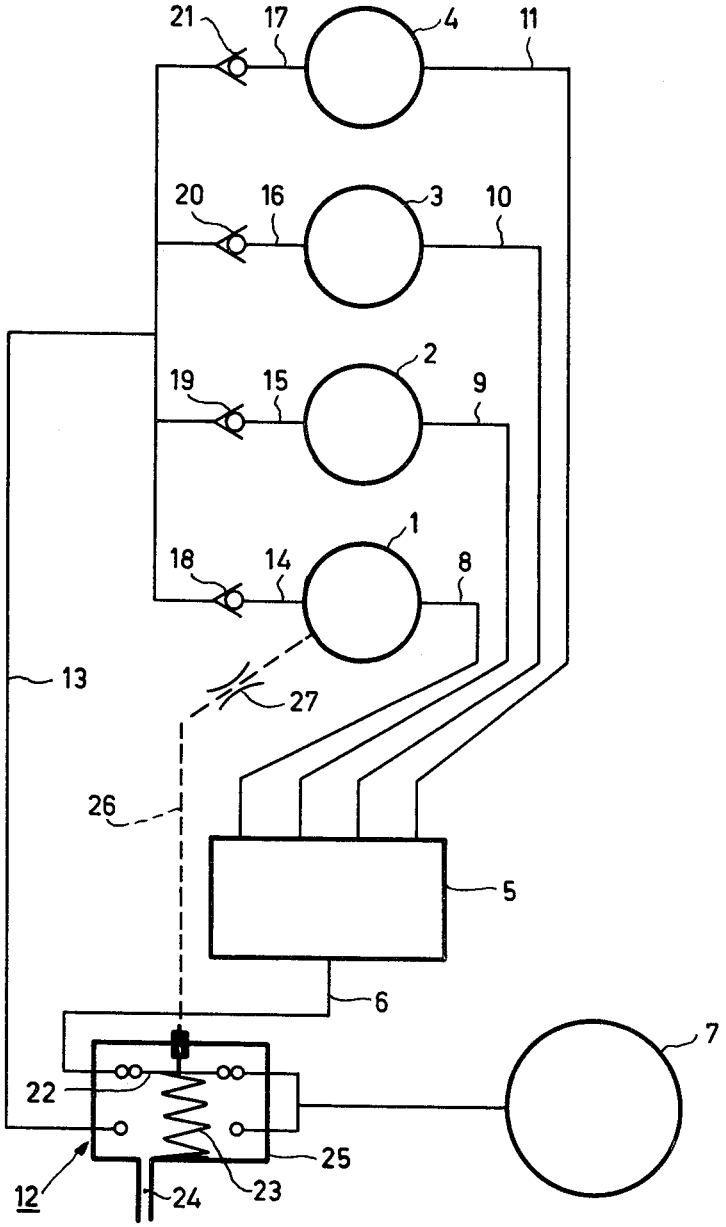
FIG. 2 is a schematic diagram of the machine in which the thermodynamic cycles shown in FIG. 1 are performed the machine, having a control device according to the invention and a pressure-controlled switch.

The reference numerals 1, 2, 3 and 4 in FIG. 2 denote the four working spaces of a hot-gas reciprocating machine in which the cycles I, II, III and IV, respectively, of FIG. 1 are performed.

A control device 5 is connected, through a duct 6, to a storage vessel 7, for pressurized working medium and is connected, through the ducts 8, 9, 10 and 11, to the working spaces 1, 2, 3 and 4, respectively.

A pressure switch 12 can interrupt the connection between the storage vessel 7 and the control device 5 and can connect the vessel to a main duct 13 which is connected, through separate communication ducts 14, 15, 16 and 17, to the working spaces 1, 2, 3 and 4, respectively. Each of the ducts 14 to 17 includes a non-return valve 18, 19, 20 and 21, respectively, which opens in the direction of the respective working space.

Each of the non-return valves 18 to 21 opens if the cycle pressure occurring in the associated working space is lower than the pressure in the duct 13. In the duct 13 normally a pressure prevails which corresponds to the minimum cycle pressure.

The pressure switch 12 has a switching element 22 which is biased on one side by a compression spring 23 and atmospheric pressure through an opening 24 in the housing 25, and on the other side is subject to the pressure which prevails in a duct 26 connected to the working space 1. The duct 26 includes a flow resistance 27 which is constructed as a capillary. As a result, the switching element 22 senses the average cycle pressure of the working space 1.

The control device 5 yet to be described is constructed so that within the interval A (FIG. 1) when $P_I$ assumes its maximum value and is larger than $P_{II}$, $P_{III}$ and $P_{IV}$, working medium is supplied from the storage vessel 7 exclusively to the working space 1.

Similarly, within the intervals B, C and D working medium is supplied exclusively to the working spaces 2, 3 and 4, respectively.

As a result of the supply of working medium each time to the working spaces during a part of the cycle in which the maximum cycle pressure occurs, the level of the maximum cycle pressure in the said working spaces increases, and the pressure in the storage vessel 7 decreases. As a result, it becomes gradually more difficult to supply working medium to the working spaces at maximum cycle pressure. Under the influence of the increasing mean cycle pressure in the working space 1, the switching element 22 gradually assumes a new position in which the connection between the storage vessel 7 and the control device 5 is interrupted and the storage vessel 7 is connected to the main duct 13. Each of the non-return valves 18 to 21 opens during the part of the associated cycle in which the cycle pressure is lower than that in the duct 13. Thus, working medium is supplied to each working space through the duct 13 during the period of minimum cycle pressure in this working space, from the instant at which the difference between the working medium pressure in the storage vessel 7 and the maximum cycle pressure in the working spaces has become so small that the supply of working medium at maximum cycle pressure is hampered.

Obviously, the pressure switch 12 may also have a different construction. Other control pressures may also be used, for example, pressures which correspond to the maximum or minimum cycle pressure.

The control device shown in FIGS. 3*a* to 3*e* comprises a housing 30 which consists of two portions 30*a* and 30*b* which are rigidly connected to each other by screws 31 and define a central inlet 32 and four outlets 33, 34, 35 and 36.

In the annular duct 37 between two housing portions 30*a* and 30*b* there is provided a flexible ring 38 of a synthetic material or of metal (for example, copper), the portions 38*a-b-c-d* thereof being capable of engaging in a sealing manner with the seats 39, 40, 41 and 42, respectively, of the outlets 33, 34, 35 and 36, respectively. During operation, the inlet 32 is connected to the storage vessel 7 (FIG. 2) and the outlets 33, 34, 35 and 36 are connected to the working spaces 1, 2, 3 and 4, respectively.

On the outer side of the portions 38 *a–d* of the ring 38 which co-operates with the seats 39 to 42 the high pressure of the storage vessel prevails, and on the inner side of these portions the variable cycle pressure of the relevant working space prevails. The maximum cycle pressure is then lower than the pressure in the storage vessel.

The varying differential pressures prevailing across the ring portions 38*a*–38*d* cause varying forces on the ring 38 which are directed radially inwards.

Because the phase of the cycle pressures differs 90° relative to each other, the direction of the resultant of the four forces changes in the time.

During the interval A (FIG. 1) $P_I > P_{II}, P_{III}, P_{IV}$. The instantaneous force on the ring portion 38*a*, therefore, is smaller than that on the ring portion 38*c*. Similarly, the instantaneous forces on the ring portions 38*b* and 38*d* are smaller than that on the ring portion 38*c*, even though they are larger than that on the ring portion 38*a*. As a result, while the ring portions 38*b*, 38*c* and 38*d* bear on the seats 40, 41 and 42, respectively, the ring portion 38*a* is situated at a distance from the seat 39. Working medium then flows to the working space 1 through the outlet 33 (FIG. 2).

Figure 3B:
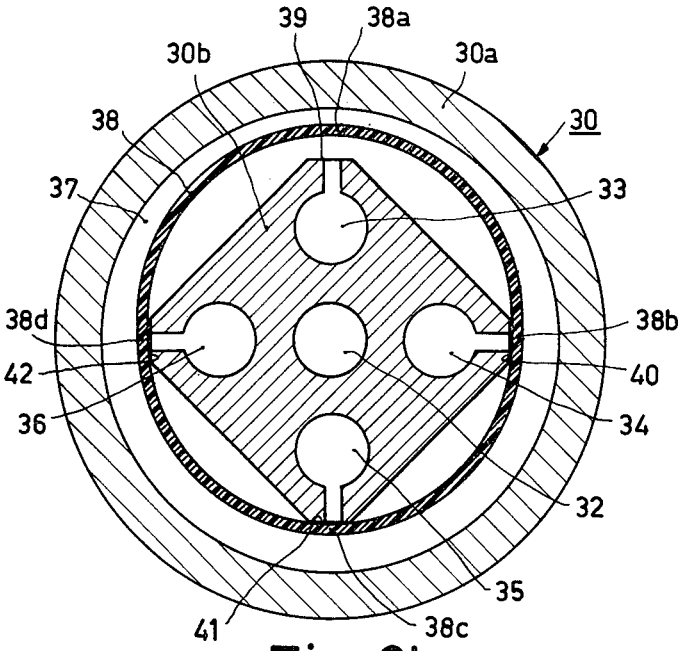
FIGS. 3*b*, 3*c*, 3*d* and 3*e* are cross-sectional views, taken along the line III—III of FIG. 3*a*, of different operating conditions of the control device.
Figure 3C:
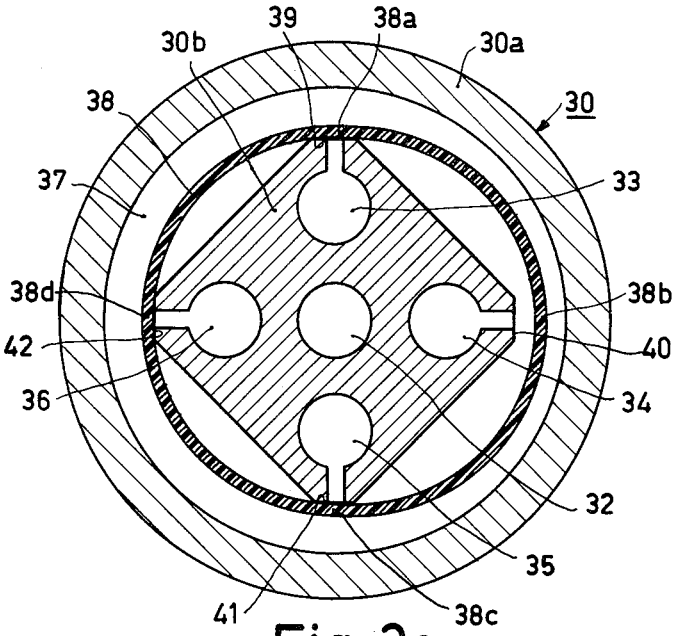
Figure 3D:
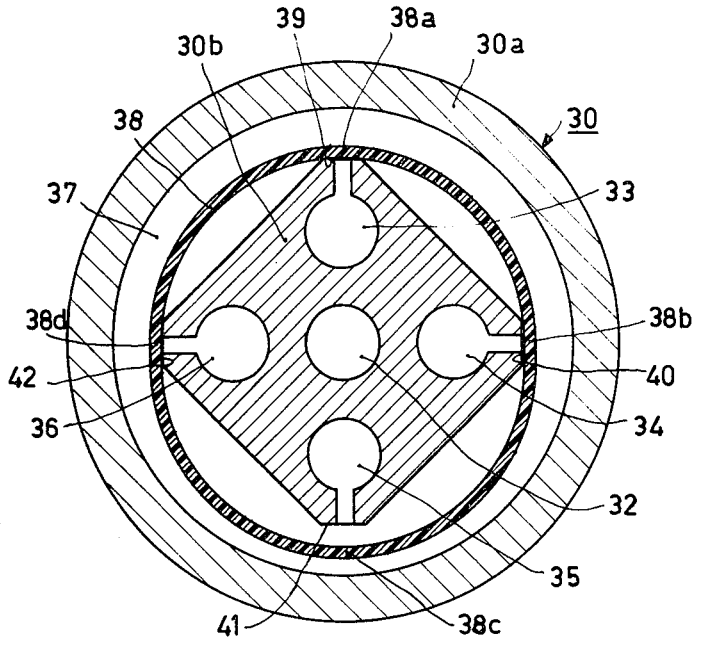
Figure 3E:
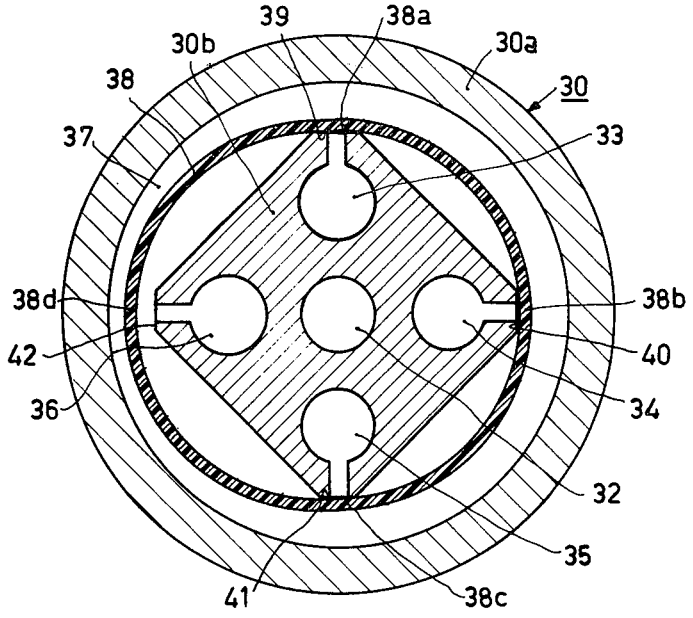

During the intervals B, C and D (FIG. 1), the situation is as shown in the FIGS. 3*c*, 3*d* and 3*e*, respectively, and working medium flows to the working spaces 2, 3 and 4, respectively.

Figure 4A:
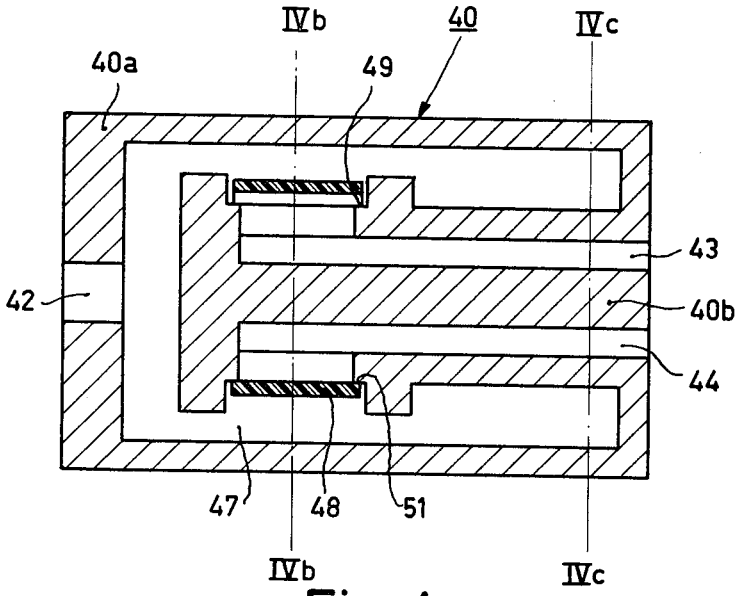
FIG. 4*a* is a longitudinal sectional view of a further embodiment of the control device.
Figure 4B:
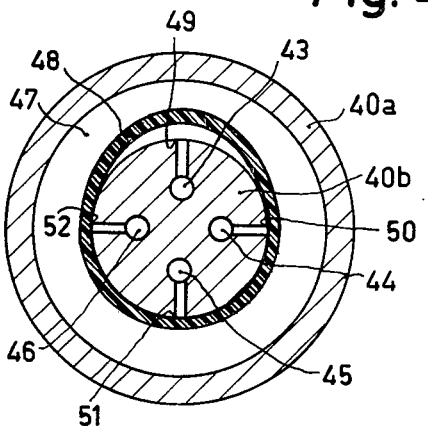
FIG. 4*b* is a cross-sectional view taken along the line IV*b*—IV*b* of FIG. 4*a*.
Figure 4C:
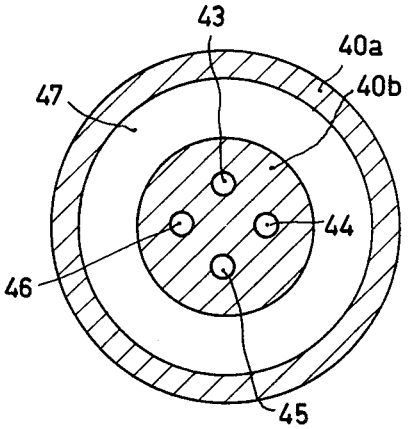
FIG. 4*c* is a cross-sectional view taken along the line IV*c*—IV*c* of FIG. 4*a*.

The control device shown in the FIGS. 4*a* to 4*c* is substantially similar to that shown in FIG. 3. The same reference numerals, increased by the number 10, have been used for corresponding parts. The operation of this device is as described with reference to the FIGS. 3*a* to 3*e*.

Figure 5A:
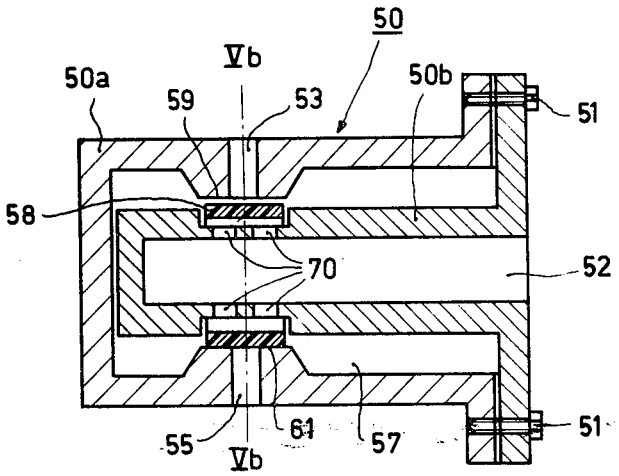
FIG. 5*a* is a longitudinal sectional view of a further embodiment yet of the control device.
Figure 5B:
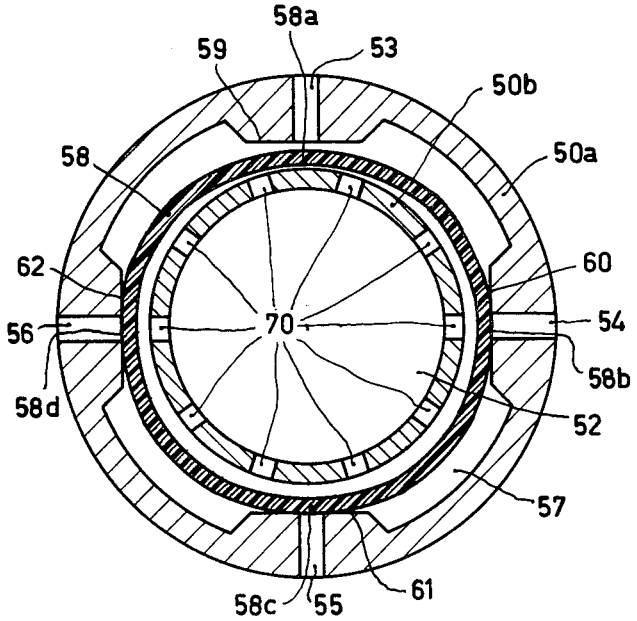
FIG. 5*b* is a cross-sectional view taken along the line V*b*—V*b* of FIG. 5*a*.

The same reference numerals, increased by the number 20, have been used for the parts of the control device shown in the FIGS. 5*a* and 5*b* which correspond to parts of the FIGS. 3*a* to 3*e*. In this embodiment the outlets are situated in the outer housing portion 50*a*. Besides the central inlet 52, bores 70 are provided in the portion 50*b*.

The operation of this device is essentially the same as that of the device shown in the FIGS. 3*a* to 3*e* except that the variable forces acting on the ring portions 58*a* to 58*d* are directed radially outwards instead of radially inwards, and these ring portions are each time pulled clear of the associated seat, instead of being pushed.

Other constructions of the control member are also possible. For example, an endless chain comprising links which act as seals can also be used. The releasing and closing of the outlets is then effected by lever action.

Even though the described embodiments involve 4-cylinder machines, the invention can be used equally well for machines having a different number of cylinders. For a 2-cylinder machine, two oppositely situated outlets of the control device suffice. For a 3-cylinder machine with a phase difference of, for example 120° between the three cycle pressures, three outlets can be arranged on a circle circumference at an angle of 120° relative to each other.

What is claimed is:

1. A hot-gas reciprocating machine with two or more working spaces whose volumes can be varied at a mutual phase difference by piston-like bodies coupled to a crank shaft, a working medium which performs a thermodynamic cycle in each of said working spaces during operation, and a control device comprising a housing having an inlet connected to a source of pressurized working medium and a plurality of outlets, each of which outlets is separately connected to an associated working space, the housing accommodating a control member which, during each revolution of the crank shaft, successively brings each of the outlets separately into open communication with the inlet, each time for a period during which the maximum cycle pressure occurs in the interconnected working space;

wherein the control member is formed by an annular body having a plurality of wall elements distributed over its circumference and arranged to be subject on one side, viewed radially, to the source pressure; and the other side of each wall element is arranged to engage in a sealing manner with an associated outlet where they are subject to the variable cycle pressure occurring in the connected working space, the body further being so arranged that said wall elements close or release the outlets by changes of the shape of this body due to the variable forces acting on this body as a result of the variable differential pressures prevailing across the wall elements.

2. A hot-gas reciprocating machine as claimed in claim 1, characterized in that the annular body consists of flexible tubing made of a synthetic material.

3. A hot-gas reciprocating machine as claimed in claim 1 comprising in addition a pressure-controlled switch which is included in a main communication duct, one end of which is connected to the source of pressurized working medium while its other end is connected to the working spaces through communication ducts which are separately connected to the working spaces, each communication duct including a non-return valve which opens in the direction of the associated working space, and the switch including means for switching off the control device and releasing the main communication duct when a given pressure level in the working space is exceeded and closing the main communication duct and switching on the control device when the pressure becomes lower than said pressure level.

* * * * *